US010753637B2

(12) United States Patent
Karamanos et al.

(10) Patent No.: US 10,753,637 B2
(45) Date of Patent: Aug. 25, 2020

(54) FRAMELESS HINGED ACCESS DOOR SYSTEM

(71) Applicant: John Chris Karamanos, San Jose, CA (US)

(72) Inventors: John Chris Karamanos, San Jose, CA (US); Scott Lee Coultas, Lindale, TX (US)

(73) Assignee: John Chris Karamanos, San Jose, CA (US)

( * ) Notice: Subject to any disclaimer, the term of this patent is extended or adjusted under 35 U.S.C. 154(b) by 56 days.

(21) Appl. No.: 16/146,558

(22) Filed: Sep. 28, 2018

(65) Prior Publication Data

US 2020/0103135 A1 Apr. 2, 2020

(51) Int. Cl.

| | |
|---|---|
| ***F24F 13/02*** | (2006.01) |
| *F24F 13/14* | (2006.01) |
| *E06B 5/01* | (2006.01) |

(52) U.S. Cl.

CPC ..... *F24F 13/029* (2013.01); *E06B 5/01* (2013.01); *F24F 13/0263* (2013.01); *F24F 13/1406* (2013.01)

(58) Field of Classification Search

CPC .. F24F 13/029; F24F 13/0263; F24F 13/1406; E06B 5/01

USPC ..... 138/92

See application file for complete search history.

(56) References Cited

U.S. PATENT DOCUMENTS 4,095,640 A * 6/1978 Beckerer, Jr. ..... E06B 3/02 114/178
4,106,236 A * 8/1978 Oliphant ..... B60J 9/02 49/141
4,130,966 A * 12/1978 Kujawa, Jr. ..... B60J 7/1642 49/141

(Continued)

*Primary Examiner* — Craig M Schneider
*Assistant Examiner* — David R Deal
(74) *Attorney, Agent, or Firm* — Panagos Kennedy PLLC; Bill Panagos; Linda Kennedy

(57) ABSTRACT

A frameless HVAC door system for reduced noise transmission leakage, and improved installation. The system includes a first member having opposed first and second surfaces and a first size that defines a first perimeter extending around the first and second surfaces. The first member is further equipped with a latch spaced apart from a hinge member on the first member. The door further includes a second member mounted on the first member first surface. The second member includes a sidewall extending around the second member to define a second member perimeter. The second member further includes a second member surface extending between the side walls and along the second member perimeter to define a compartment. The compartment is insulated against noise and temperature change. The second member perimeter is smaller than the first member perimeter, which defines a flange extending from the second member perimeter to the first member perimeter to define a flange perimeter. The flange is equipped with a resilient elastic foam sealing material along its perimeter. The first member is hingedly mounted to a surface around an opening for pivotal movement relative thereto. When the latch engages the latch receiver, it distributes a uniform compressive sealing force along the flange when the first member is in a closed position relative to the opening.

10 Claims, 2 Drawing Sheets

(56) References Cited

U.S. PATENT DOCUMENTS

| | | | | | |
|---|---|---|---|---|---|
| 4,572,240 | A * | 2/1986 | Van Becelaere | F16L 45/00 | 138/92 |
| 4,890,418 | A * | 1/1990 | Sachs | E04F 19/08 | 49/380 |
| 5,067,278 | A * | 11/1991 | Lyons | F16L 45/00 | 292/241 |
| 6,683,247 | B1 * | 1/2004 | McTavish | H02G 3/14 | 138/92 |
| D635,098 | S * | 3/2011 | Ismert | E04F 19/08 | D13/152 |
| 8,100,363 | B2 * | 1/2012 | Ponsart | B64C 1/1446 | 244/129.4 |
| 8,745,926 | B2 * | 6/2014 | De Domenico | E05B 35/008 | 49/465 |
| 2014/0190087 | A1 * | 7/2014 | Chwala | E05B 35/008 | 49/460 |
| 2018/0044974 | A1 * | 2/2018 | Ivasiv | E05C 3/042 | |

* cited by examiner

FRAMELESS HINGED ACCESS DOOR SYSTEM

TECHNICAL FIELD

In heating and cooling industry, access openings in ductwork are necessary to permit technicians access to certain heating, ventilation and air conditioning (HVAC) system components or areas of ductwork for service reasons. These access openings usually have a frame on which an access door is attached by a hinged mechanism. The frames are attached to the openings and secured in place and the access doors are them hung on hinges to close the access opening in the duct. Many times, the frames are improperly mounted or the access openings were improperly sealed, resulting in air escaping from the duct work. The escaping air creates a number of issues. The vibration and noise associated with air under pressure escaping form a duct oftentimes results in needless customer calls to service providers, who are often times not able to address the complaint. In addition, leaking air from the ducts reduces efficiency of the HVAC, thereby increasing operating costs. Another problem with access doors on HVAC ducts is that without proper insulation, water will condense on the door surface. Oftentimes, the air in the duct is a different temperature than the ambient air. Condensation can occur, especially where air is leaking from the duct. Such condensation on the access doors may result in water damage to ceiling tiles or mold problems. Another issue is retrofitting an existing duct with an access door.

There is a need for a frameless access door in an HVAC duct system that is hingedly mountable to an opening surface, seals the access openings in ductwork, stops air leaks through the access opening and reduces or eliminates condensation on the access door, and can be retrofitted onto an existing duct at an economical price point.

SUMMARY

In one embodiment, the insulated compartment door may include a first member or door portion. The first member or door has opposed first and second surfaces. The member has a first size defining a first perimeter extending around the opposed first and second surfaces. The first member has a cam latch spaced apart from a moveable joint or hinge member. The first member is mountable by a hinge or moveable joint to an opening surface in the HVAC duct for pivotal movement relative thereto. The first member further is equipped with a latch that interacts with a latch member to apply uniform compressive force to the first member against the HVAC access opening. The latch may be located opposite to the hinge. A second member, is mounted on the first member. Generally the second member is sized to fit within the HVAC access opening. In some embodiments, the second member may be concentrically mounted on the first member. The second member includes sidewalls extending around the second member to define a second member perimeter. The sidewalls have a length and width and depth. A second member plate extends between the sidewalls and along the second member perimeter to define a compartment. The second member compartment is equipped with insulation, such as an acoustic and/or a thermal insulation. The second member perimeter is smaller than the first member perimeter to define a flange extending from the second member perimeter to the first member perimeter. The flange is equipped with a resilient sealing material such as an elastic foam material. The flange sealing material is cooperatively engageable with the access opening when the cam latch engages a recess in the frame and distributes a uniform compressive sealing force along said flange when said first member is in a closed position relative to said opening.

The frameless access door is less expensive to manufacture and easier install on HVAC access openings than current access doors with a frame and much easier to install for retrofit applications. Specifically, after the access opening is created in the HVAC duct, the frameless access door is placed over the access opening. The second member, which may include an insulated compartment, fits into the access opening and may act to guide the positioning of the frameless access door on the access opening. The flange extends beyond the size of the access opening and the elastic foam engages the HVAC duct work surface around the entire perimeter of the access opening. The hinge, which may be a piano hinge or other type of movable joints that connect two objects while allowing at least one of the objects to pivot, is secured to the HVAC ductwork surface, and the latch mechanism applies a relatively uniform force along the flange to seal the access opening.

BRIEF DESCRIPTION OF THE DRAWINGS

Turning now to the drawings wherein like numbers refer to like structures, FIG. 1 shows one embodiment of the frameless access door system 10 mounted on an HVAC duct 12 adjacent an access opening 14. The frameless access door 16 has a first member 18 having a first surface 20 and a second surface 22 in opposed relationship to each other. The first member has a first size and a perimeter extending around the first and second surfaces. The first member is of sufficient size to overlay the access opening 14. The first member has a moveable joint, shown as a hinge member 24 and a latch shown as a cam latch member 26 in spaced apart relationship. As shown, the hinge may be a piano hinge secured to the HVAC duct surface. In the embodiment of FIG. 1, the moveable joint, shown as a hinge and the cam are mounted on the first member opposite to each other. It is understood that the door may be hingedly attached to the surface around an opening of the duct for movement about the moveable joint relative to the duct and permit access to the opening. A latch receiver 28 is mounted on the HVAC duct surface at a position to be in cooperative engagement with the latch member.

Figure 1:
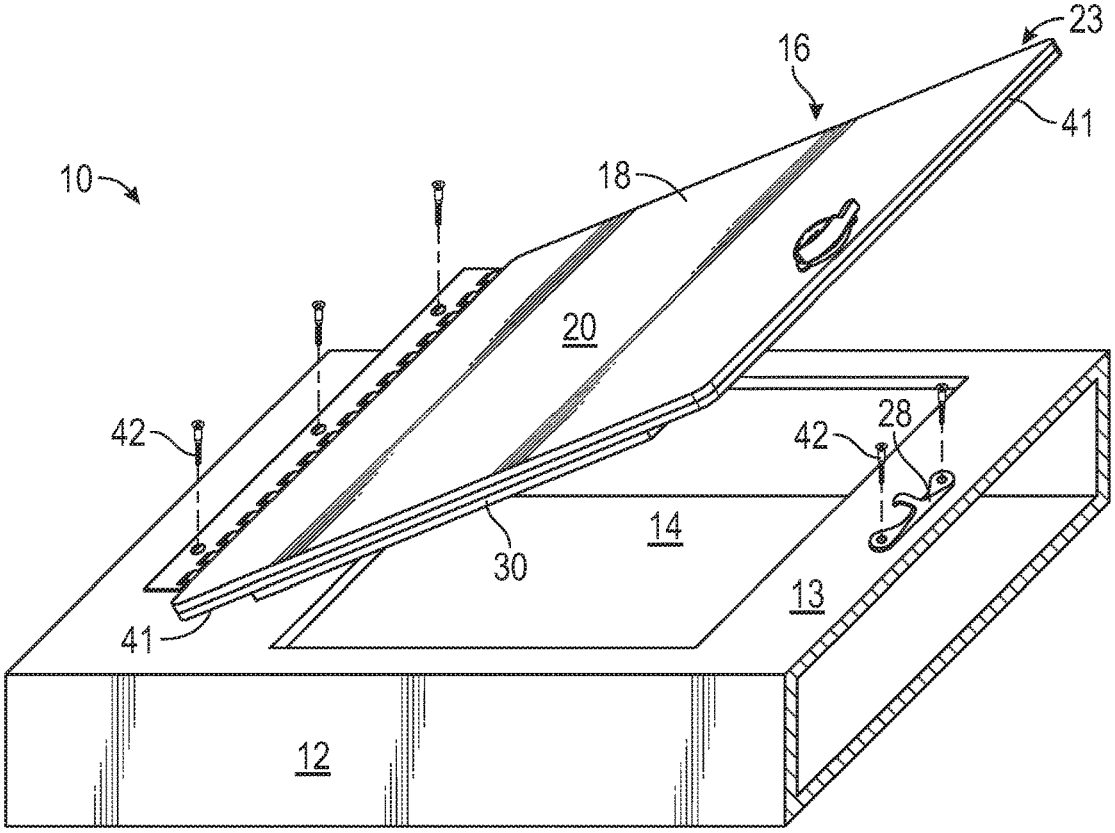
FIG. 1 is a view of an HVAC duct with an access opening with a frameless access door affixed to the duct.
Figure 2:
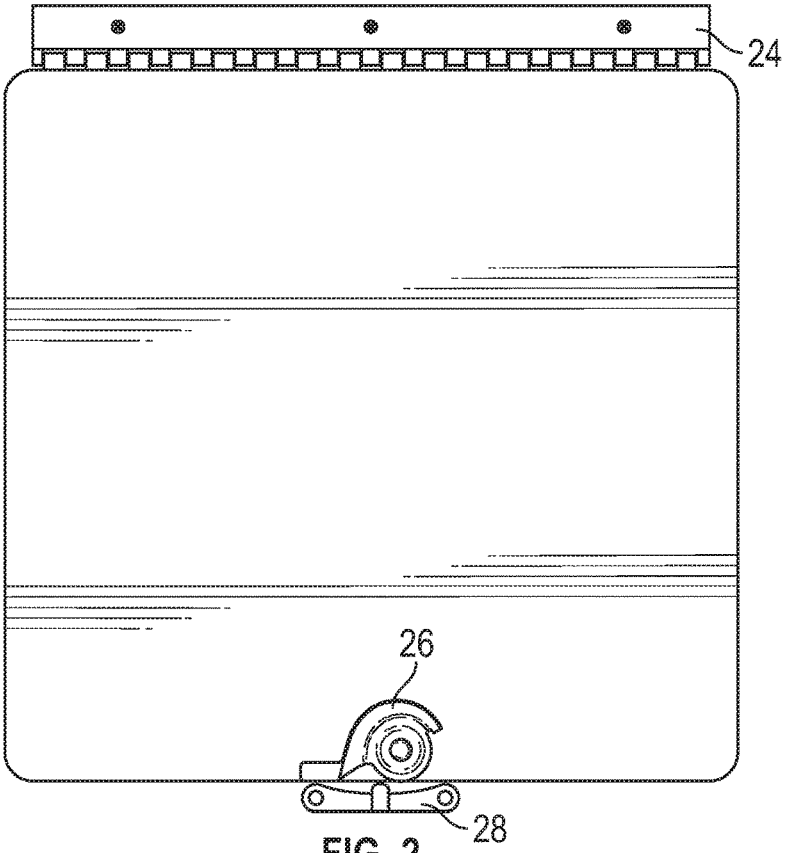
FIG. 2 is a top plan view of a frameless access door
Figure 3:
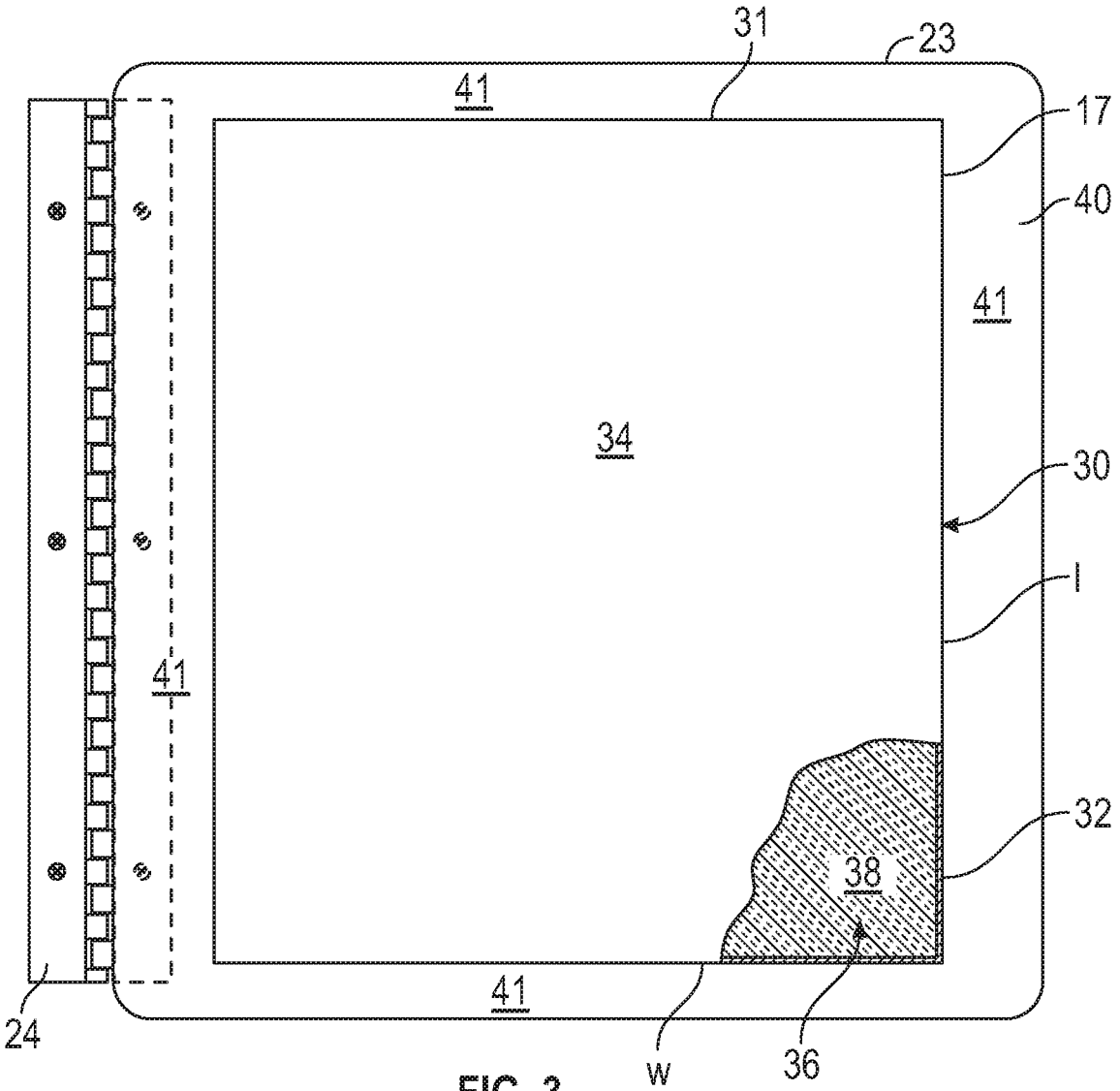
FIG. 3 is a cutaway view showing the compartment on the access door
Figure 4:
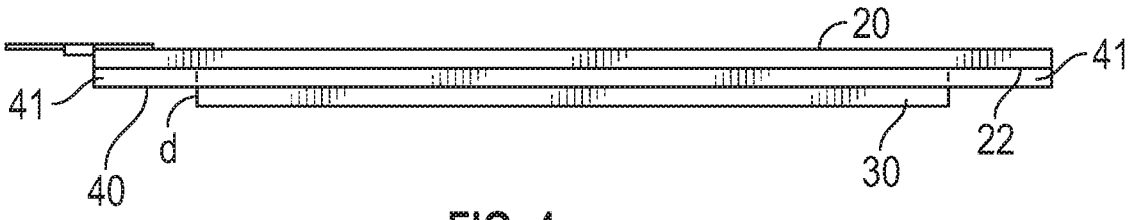
FIG. 4 is an on side view of the frameless access door, showing its construction.

Second member 20 is mounted on the second surface 22 of first member 20. The second member has sidewalls 32 having a length "1", a width "w" and a depth "d". A plate member 34 is affixed to the sidewalls, and extends across the sidewalls to define a compartment 36. The compartment 36 may include insulation material 38, which may be acoustical and/or thermal insulation. The insulation material mutes the transmission of noise through the door attendant with the flow of air through the HVAC system. In addition, the insulation prevents the condensation of moisture droplets on the first surface of the first surface member. The second member has a perimeter defined by the sidewalls which is smaller than the perimeter of the first member. The second perimeter may be generally the size of an access opening in the surface of an HVAC duct. In that regard, the second member may act as a location guide for placing the access door on the HVAC duct. In some embodiments the second member is concentric with the first member. A flange 40 is defined between the second perimeter of the second member to the first perimeter of the first member. The flange may be equipped with an elastic foam material, such as a closed cell elastic foam material or a polyurethane material. The elastic foam material on the access door flange overlies the HVAC duct surface and effectively seals the flow of air from the access opening in the duct.

An operator may easily install the frameless access door system with a minimum of effort. The door is positioned by placing the second member into the access opening to locate the door on the HVAC duct. The hinge is fastened in place on the surface of the HVAC duct, as by screws 42 or rivets or other suitable fasteners. The latch receiver 28 is positioned on the HVAC duct surface for cooperative engagement with the cam latch and secured thereto by screws 42. The latch engages the latch receiver and applies a uniform pressure along the entire flange, thereby compressing the elastic foam sealing material to provide for a sealing engagement that does not permit the air in the HVAC duct to escape around the flange through the access door.

It is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

We claim:

1. A frameless door system, comprising:

a first member; said first member having opposed first and second surfaces; said first member having a first size defining a first perimeter extending around said first and second surfaces; said first size larger than an opening in an opening surface; said first member having a latch spaced apart from a hinge member on said first member; said first member hingedly mountable to said opening surface for pivotal movement relative thereto; said latch engageable with a latch receiver located on said opening surface;

a second member on said first member first surface; said second member including a sidewall extending around said second member to define a second member perimeter; said sidewall having a length and width and depth; said second member further including a second member surface extending between said side walls and along said second member perimeter to define a compartment; said second member equipped with insulation in said compartment; said second member perimeter smaller than said first member perimeter to define a flange extending from said second member perimeter to said first member perimeter to define a flange perimeter; said flange equipped with a resilient sealing material along said flange perimeter; said flange sealing material cooperative engageable with said opening surface when said latch engages said latch receiver and distributes a uniform compressive sealing force along said flange when said first member is in a closed position relative to said opening.

2. The frameless door system of claim 1, wherein said second member is concentrically mounted on said first member.

3. The frameless door system of claim 1, wherein said second member is sized to fit within said opening.

4. The compartment door system of claim 1, wherein said hinge member is mounted on said first surface of said first member opposite said cam latch member.

5. The compartment door system of claim 1, wherein said insulation includes acoustic and thermal insulation.

6. The frameless door system of claim 1, wherein said sealing material is an elastic foam material.

7. The frameless door system of claim 6, wherein said elastic foam material is a closed cell foam material.

8. The frameless door system of claim 1, wherein said hinge member is a piano hinge.

9. The frameless door system of claim 1, wherein said hinge member is a moveable joint.

10. A method to mount a frameless door system over an access, comprising; placing a access door having a first member with first and second opposed surfaces over an access in a surface defining a first perimeter; said first member equipped with a moveable joint member in spaced apart relation to a latch member; a second member mounted on said second surface; said second member having sidewalls extending around said second member to define a second periphery; said sidewalls defining a compartment; said compartment including insulating material, said second perimeter and said first perimeter defining a flange therebetween; said flange including an elastic foam material; placing said second member into the access to locate the door system relative to the access; securing the movable joint member in place to permit pivotal movement of said first member relative to the access; securing a latch receiver in cooperative engagement with the latch member to secure the door system in place over the access.

* * * * *